United States Patent [19]

Meyers et al.

[11] Patent Number: 4,503,975

[45] Date of Patent: Mar. 12, 1985

[54] NAILPOLISH PACKAGE

[75] Inventors: George Meyers; David C. Mueller, both of Ashland, Ohio

[73] Assignee: The Garber Company, Ashland, Ohio

[21] Appl. No.: 488,431

[22] Filed: Apr. 25, 1983

[51] Int. Cl.[3] ..... B65D 73/00; B65D 75/02; B65D 652/16

[52] U.S. Cl. ..... 206/486; 206/806; 248/152

[58] Field of Search ..... 206/486, 490, 806, 476, 206/418; 248/152

[56] References Cited

U.S. PATENT DOCUMENTS

| | | | |
|---|---|---|---|
| 2,949,185 | 8/1960 | Foote et al. | 206/486 |
| 3,685,649 | 8/1972 | Diehl | 206/462 |
| 4,128,168 | 12/1978 | Roccaforte | 206/476 |
| 4,201,294 | 5/1980 | Roccaforte | 248/152 |

FOREIGN PATENT DOCUMENTS

| | | | |
|---|---|---|---|
| 8200168 | 8/1982 | Netherlands | 206/44 R |

*Primary Examiner*—William T. Dixson, Jr.
*Assistant Examiner*—Brenda J. Ehrhardt
*Attorney, Agent, or Firm*—Yount & Tarolli

[57] ABSTRACT

A display package for an article such as a nailpolish bottle is formed from a single sheet of material which is folded into the package. The package includes an article retaining portion and a display portion for containing display material. The article retaining portion includes a three layer bottom portion, an angle panel joined to one end of the bottom portion, and an upright panel joined to the opposite end of the bottom portion. The angle panel and upright panel are foldably joined at their other ends. The angle panel includes an opening dimensioned to allow part of the article to be visible for display purposes while at the same time to prevent the article from being removed through the opening. The display portion of the package comprises a single layer back panel which extends upwardly from the article retaining portion of the package. The display portion is a single thickness of material, while the package back is of a double thickness on the lower part of the package.

7 Claims, 6 Drawing Figures

NAILPOLISH PACKAGE

This invention relates generally to a display package for an article. Specifically, this invention relates to a package for retaining and displaying an article such as a bottle of nailpolish, a blank which is folded to form the package, and a method of forming the package. The package is adapted to retain the article in a manner which prevents the article from being removed from the package, while at the same time allowing a substantial portion of the article to be visible for display purposes.

BACKGROUND OF THE INVENTION

Packages for displaying articles such as nailpolish bottles generally are formed from two separate pieces, a flat back piece of paperboard and a plastic retaining part which fits around the article and attaches to the back panel to hold the article in position against the back panel. It is desirable in such packages that the article be securely retained in the package to prevent theft of the article, especially when the article is one which is small and easily concealed like a nailpolish bottle. It is also desirable that the package permit a substantial portion of the article to be visible in order to attract a customer's attention and allow the customer to see the article.

U.S. Pat. No. 4,331,237 discloses a package for holding a nailpolish bottle. The package includes a flat display card and a plastic display clip which encircles the top and bottom of the bottle and which has tab portions for joining the display clip to the display card. The tab portions are inserted through holes in the display card, and are then subjected to heat and pressure so as to spread out and flatten the tabs against the rear face of the display card, thus securing the display clip onto the display card. Since the display clip surrounds the main body of the bottle, the bottle is held in position against the display card and may not be removed therefrom.

U.S. Pat. No. 4,119,203 discloses a reclosable hinged blister card package wherein a clear plastic blister is adhered to a paperboard card. The blister is hinged at its bottom end to the card, and has a tab at the upper end which is pushed through an opening in the card to lock the blister in a closed position against the card. This package, like blister packs generally, has two separate parts which must be joined to each other to form the finished package.

SUMMARY OF THE INVENTION

The present invention provides an improved package for retaining and displaying an article. The package is formed from a single sheet of material such as paperboard. The package includes a display portion for containing display material, and an article retaining portion.

The package has a single thickness back panel which extends along the length of the back of the package. The display portion of the package comprises that portion of the back panel which extends upwardly from the lower, article retaining portion of the package.

The article retaining portion of the package includes an angle panel having an opening therethrough. A portion of the article extends through the opening to allow the article to be displayed. The opening is dimensioned so that the article may not be removed from the package, through the opening, once the package has been formed about the article.

The bottom portion of the package, upon which the article rests, is formed of three thicknesses of material. An upright panel extends between and connects the bottom portion and the upper end of the angled panel. The back panel, which extends upwardly from the bottom portion of the package, lies adjacent and against the upright panel for only a portion of the length of the back panel. The package thus has a double thickness of material where the back panel and upright panel lie adjacent each other, and a single thickness upwardly therefrom in the display portion.

The package of the present invention is formed from a blank which is folded into the package. The blank comprises a single longitudinally extending sheet of material which has a series of score lines extending transversely to the longitudinal extent of the sheet and dividing the sheet into a series of panels. One of these panels, the angle panel, has an opening cut through so that the blank may be folded about the article and glued, and a portion of the article will extend through the opening while the article is retained in the package.

It is sometimes desired to foil coat only the front face of the package blank for an attractive visual appearance. The present blank is of a configuration such that the front face of the angle panel and the front face of the back panel are on one face of the sheet, while the back face of the back panel is formed from the opposite face of the sheet. Therefore, if the blank is foil coated on the front face only, the back face will remain uncoated and available for printing display material thereon.

BRIEF DESCRIPTION OF THE DRAWINGS

The foregoing and other features of the present invention will become apparent to one skilled in the art to which the invention pertains upon a consideration of the following description taken in connection with the accompanying drawings wherein.

DESCRIPTION OF PREFERRED EMBODIMENT

Figure 1:
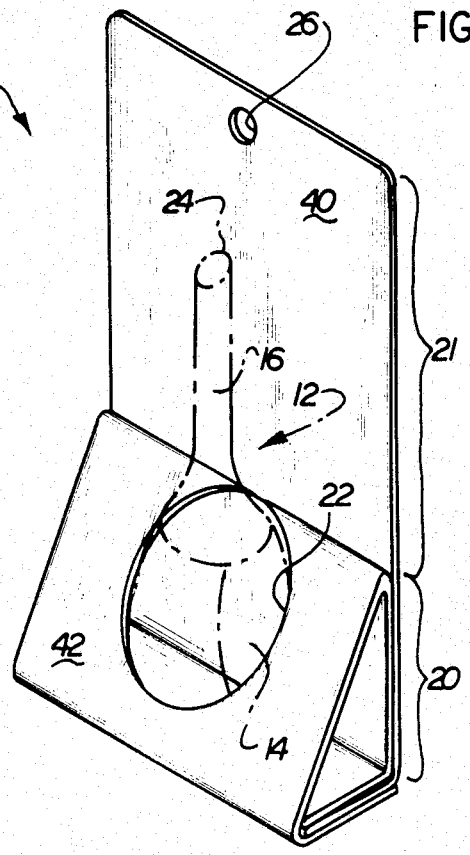
FIG. 1 is a pictorial view of a package formed in accordance with the invention, showing in phantom an article contained therein.

FIG. 1 illustrates a package 10 having an article 12 (shown in phantom) contained therein. The article 12 as illustrated in FIG. 1 is a nailpolish bottle. The article 12 includes a bottle portion 14 and a cap portion 16. The lower part of the bottle portion 14 is of a larger cross sectional dimension than the upper part of the bottle portion 14 and the cap portion 16, as may also be seen from FIG. 2.

Package 10 includes an article retaining portion 20 and a display portion 21. Article retaining portion 20 includes an opening 22 through which the article 12 extends when article 12 is retained in the package 10. Opening 22 is dimensioned so that it is smaller than the largest cross-sectional dimension of article 12. Article 12 therefore may not be removed from the package through opening 22 once article 12 is in package 10.

Display portion 21 of package 10 extends upwardly from retaining portion 20, past the upper end 24 of article 12. An opening 26 near the upper end of display portion 21 allows package 10 to be hung from a rod on a display stand. The display portion 21 is available for printing display material and identifying information describing article 12.

The bottle portion 14 (FIG. 2) of article 12 is disposed within retaining portion 20 of the package. Bottle portion 14 extends through opening 22 in retaining portion 20, allowing part of bottle portion 14 and all of cap portion 16 to be visible. Display portion 21 of package 10 extends upwardly past the upper end 24 of article 12.

Retaining portion 20 of package 10 includes a bottom portion 30 (FIG. 2) which includes a first bottom panel 32, a second bottom panel 34, and a third bottom panel 36. An upright panel 38 extends from second bottom panel 34 adjacent a back panel 40. An angle panel 42 extends between upright panel 38 and third bottom panel 36. Angle panel 42 includes opening 22 through which article 12 extends.

Display portion 21 of package 10 is the upper portion of back panel 40, and is formed of a single thickness of material. The lower portion of back panel 40, together with upright panel 38 to which it is glued, forms a double thickness of material in the article retaining portion 20 of package 10. Together with the three layer bottom portion 30, this provides strength in the article retaining portion 20, while display portion 21 is only of a single thickness to minimize material usage.

The package 10 is formed from a blank 50 (FIG. 3) which is folded to form package 10. Blank 50 comprises a longitudinally extending sheet of material having a series of transversely extending score lines which divide blank 50 into a series of panels. Back panel 40 is separated from first bottom panel 32 by score line 52. First bottom panel 32 is separated from second bottom panel 34 by score line 54. Second bottom panel 34 is separated from upright panel 38 by score line 56. Upright panel 38 is separated from angle panel 42 by score line 58. Angle panel 42 is separated from third bottom panel 36 by score line 60.

Blank 50 may be formed from any material as desired for the particular application. In the preferred embodiment, blank 50 is formed from what is commonly known as paperboard, of a thickness of approximately one-half millimeter. The paperboard is relatively stiff, and once scored, is easily foldable about the score lines to form a relatively strong package. Blank 50 may have rounded upper corners 27 as desired.

Figure 2:
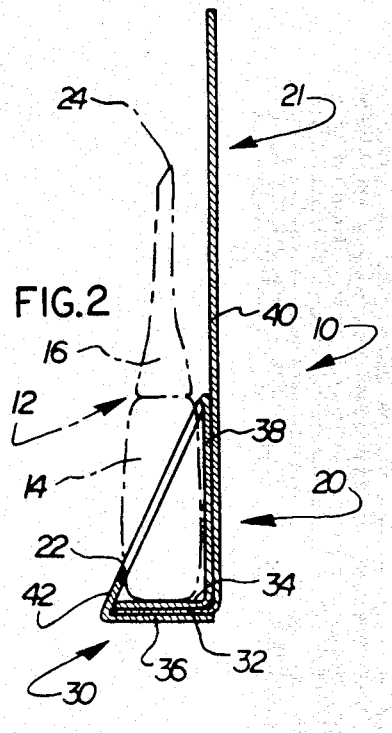
FIG. 2 is a sectional view.

Score lines 52, 54, 56, 58 and 60 are not all identically formed. Score lines 56, 58, and 60 are single score lines where the material is not cut through. At score line 54 the blank 50 is cut through at spaced locations 62 to be able to fold second bottom panel 34 back upon first bottom panel 32, about score line 54, so that the panels lie flat against each other, as shown in FIG. 2. Score line 52 includes a pair of score lines 64, 66 spaced about a small area of material 68. This provides for a fold with a larger radius to more easily accommodate the adjoining fold between second bottom panel 34 and upright panel 38 along score line 56.

Figure 3:
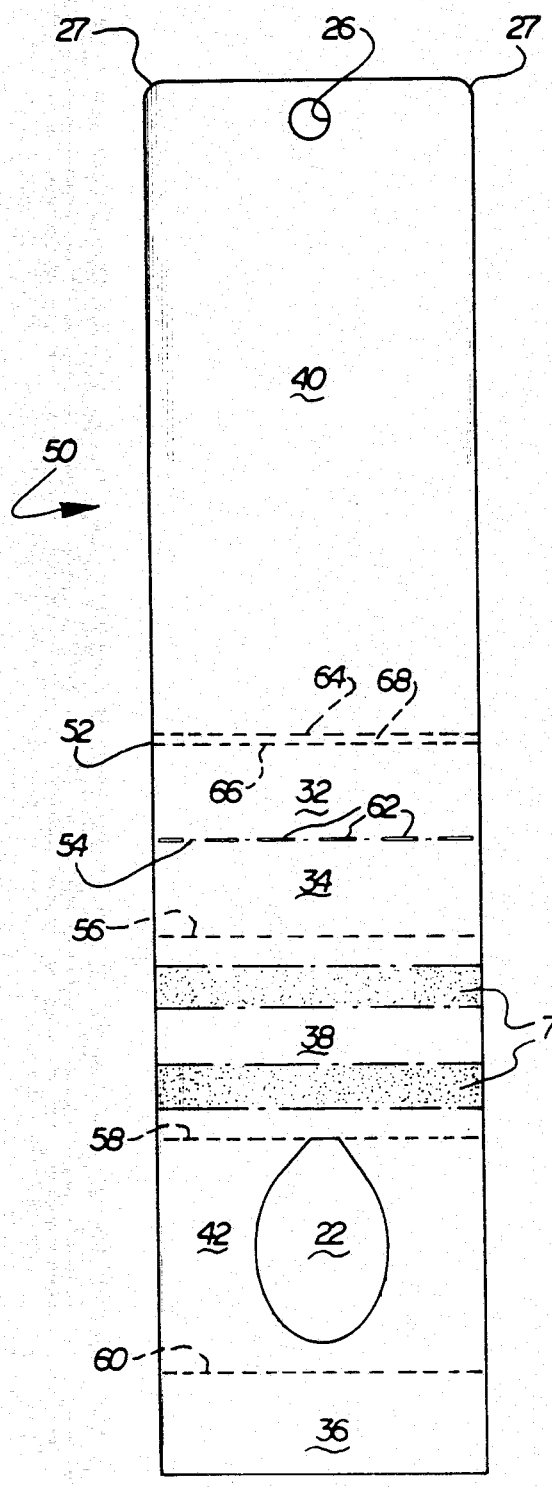
FIG. 3 is a plan view of a blank from which the package of FIG. 1 is formed.

Angle panel 42 includes opening 22. Opening 22 is cut to the desired shape for whatever article is to be retained and displayed in the package 10. As illustrated in FIG. 3, in the preferred embodiment, opening 22 is wider at the bottom than at the top, for two reasons. First, article 12 (FIG. 1) is wider at its lower portion than at its upper portion. Second, opening 22 is made smaller at its upper end to prevent article 12 from being removed from the package 10 through opening 22. This can be more clearly seen in FIG. 1.

Gluing areas are provided on blank 50, where glue or another adhesive may be applied in order to secure the various panels to each other after blank 50 has been folded into package 10 with article 12 contained therein. As illustrated in FIG. 3, upright panel 38 has two gluing areas 70 indicated thereon. With glue applied to gluing areas 70 before the blank 50 is folded, the gluing areas 70 will abut back panel 40 when blank 50 is folded, as seen in FIG. 2, and upright panel 38 will thereby be secured to back panel 40. Another gluing area (not shown) is also provided on the back face of third bottom panel 36. When the blank 50 is folded into package 10, the glue which is put on the back face of third bottom panel 36 will secure third bottom panel 36 to first bottom panel 32, as seen in FIG. 2. The entire package 10 will then be secured together about article 12.

Figure 4:
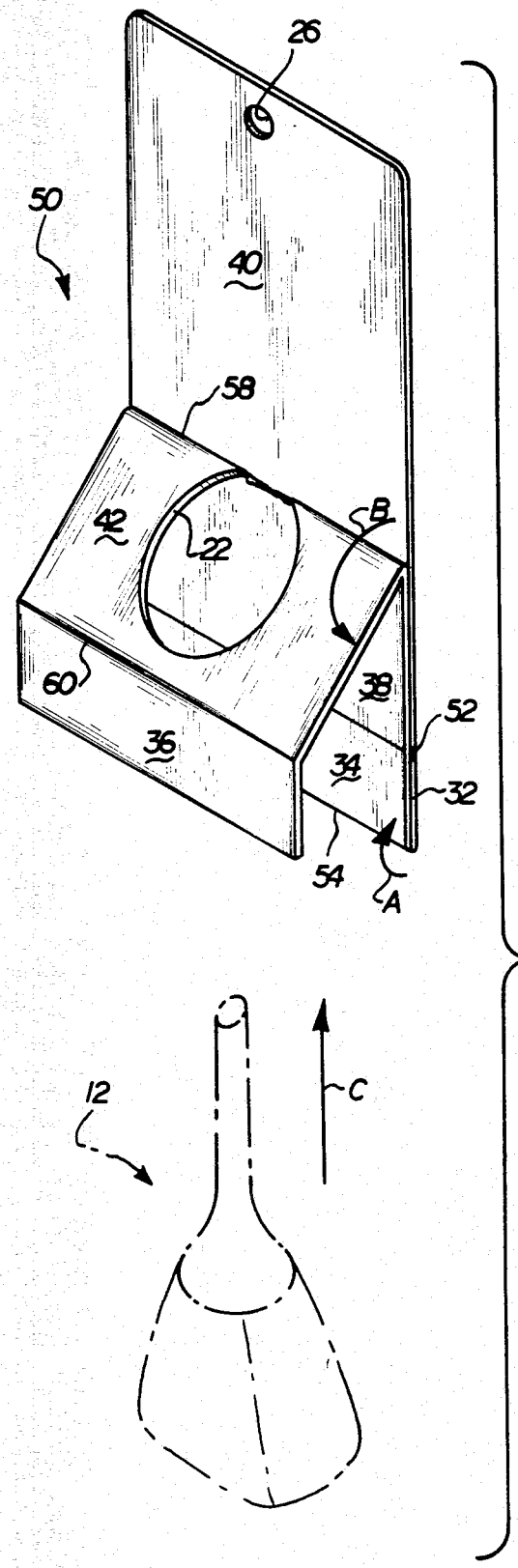
FIG. 4 is a pictorial view illustrating how the article is inserted in a partially folded blank.

FIG. 4 illustrates a partially folded blank 50 into which article 12 is ready to be inserted. Blank 50 has been folded about score line 54, as indicated by arrow A, so that second bottom panel 34 and upright panel 38 lie flat against back panel 40. With glue having been applied to gluing areas 70 beforehand, upright panel 38 is thus secured to back panel 40. Angle panel 42 is then folded down relative to upright panel 38, along score line 58, as indicated by arrow B, to extend at an angle from the plane of back panel 40. Article 12 is then inserted through opening 22 in angle panel 42 in the direction indicated by arrow C.

Figure 5:
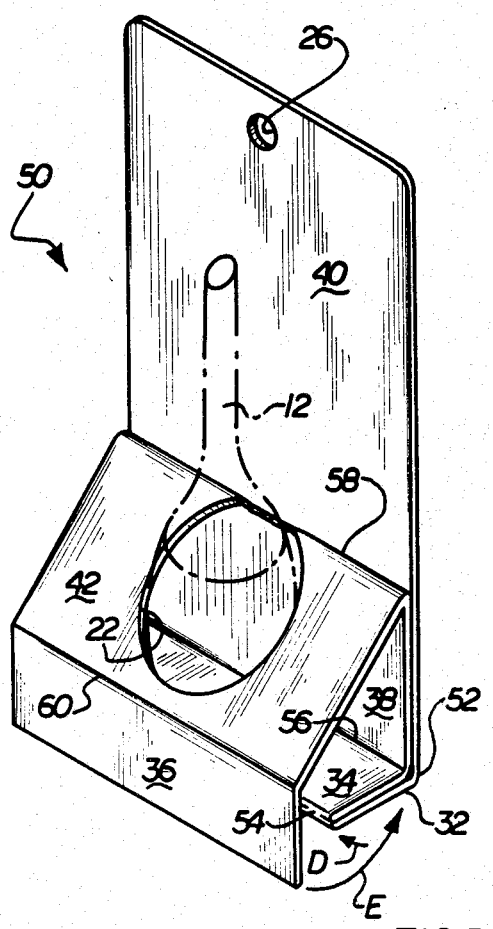
FIG. 5 is a pictorial view illustrating the folding of the blank about the article.

FIG. 5 illustrates the remainder of the folding process of blank 50 about article 12, which extends through opening 22 in angle panel 42. First bottom panel 32 and second bottom panel 34 are folded at right angles relative to back panel 40 and upright panel 38, along scores lines 52 and 56, respectively, as indicated by arrow D. Angle panel 42 is then folded down along score line 58 until score line 60 lies adjacent score line 54.

Glue is then applied to the back face of third bottom panel 36. Third bottom panel 36 is then folded in the direction indicated by arrow E to lie flat against first bottom panel 32 and be secured thereto. This gluing, in conjunction with the gluing of upright panel 38 to back panel 40, secures the entire package 10 and article 12 is securely held within the package 10. Since opening 22 is dimensioned to be smaller than the largest cross sectional dimension of article 12, article 12 may not be removed from the package 10 through the opening 22, and article 12 is thus securely retained in package 10.

Figure 6:
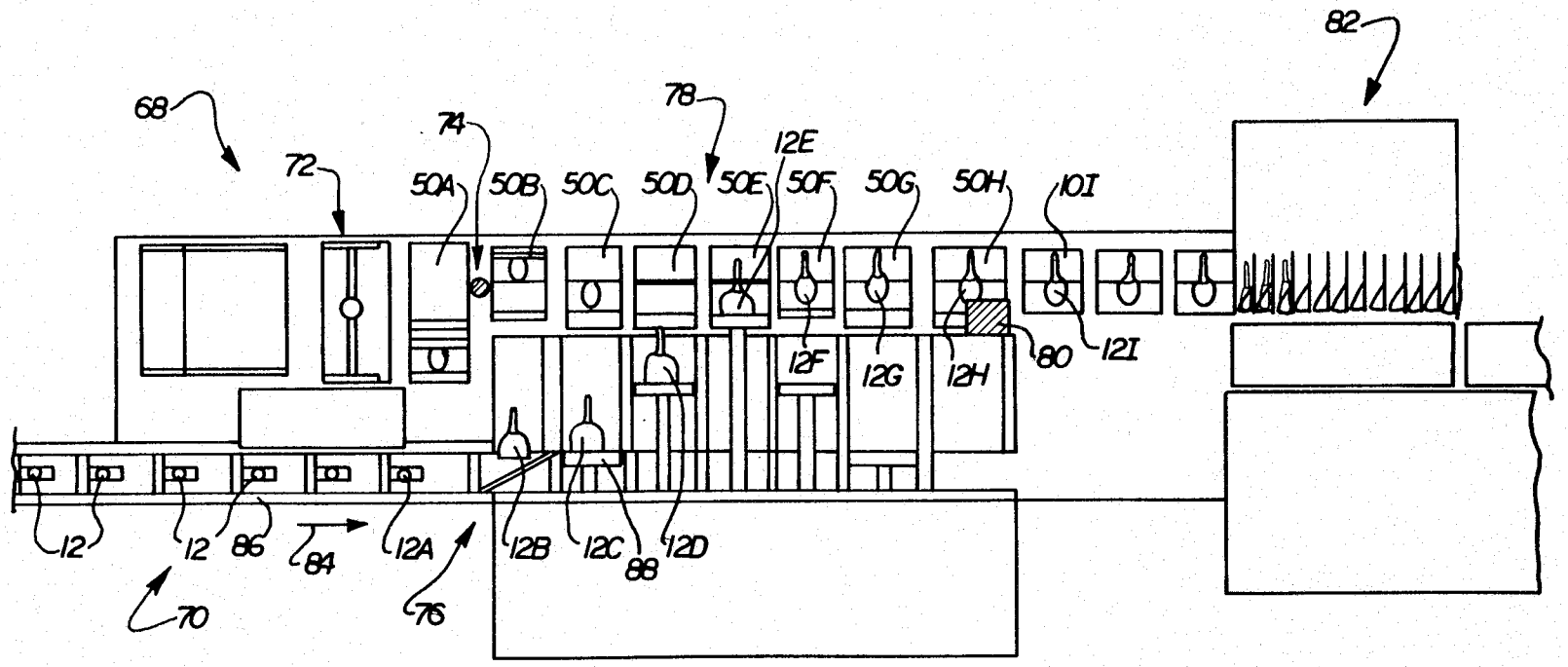
FIG. 6 is a plan view of an apparatus for forming the package of FIG. 1.

FIG. 6 illustrates an apparatus 68 which may be used for folding a plurality of blanks 50 about a plurality of articles 12 to form completed packages 10. Apparatus 68 includes an article infeed station 70, a blank feed station 72, a gluing station 74, a tipping station 76, a loading station 78, a second gluing station 80, and a collating station 82. A plurality of evenly spaced apart articles 12 are moved in a direction as indicated by arrow 84 along a conveyor 86. A plurality of blanks 50 are stored in the feed area 72 of the apparatus 68. The articles 12 and the blanks 50 are joined to each other and secured together as hereinafter described, with blanks 50 and articles 12 at different locations along apparatus 68 being indicated with corresponding alphanumeric reference numerals.

Blank **50*a* (FIG. 6) is shown in an unfolded position, from which position it will be joined with article 12*a***.

Glue is applied to upright panel 38 at gluing station 74, and the blank 50*a* is then folded to the position shown at 50*b*. Meanwhile, article 12*a*, which is in an upright orientation at 12*a*, is tipped at tipping station 76 so that it now lies flat as indicated at 12*b*. Article 12*c* is then engaged by pusher 88 which pushes article 12*c* toward blank 50*c*. As shown at 50*d*, angle panel 42 is positioned so that the article to be inserted, here article 12*d*, may be inserted through the opening 22 (not shown) in the angle panel 42. This is seen more clearly at 50*e*, where article 12*e* extends through the opening 22 in blank 50*e*.

At 50*f* and 50*g*, the first bottom panel 32 and second bottom panel 34 are folded perpendicular to back panel 40, and angle panel 42 is folded down toward first bottom panel 32 and second bottom panel 34 (as seen in FIG. 5). At 50*h* (FIG. 6) glue is applied at gluing station 80 to the back face of third bottom panel 36, and third bottom panel 36 is then folded and secured to first bottom panel 32. A completed package 10*i*, with an article 12*i* securely retained therein, results. The finished packages 10 are collated in a collating station 82, from which they may be further processed.

Blank 50 may be printed or coated in order to provide a pleasing appearance and to provide for identifying display material. It is often desired to coat packages such as nailpolish packages on one side with a foil coating which provides an attractive, eye-catching appearance leaving the back panel uncoated and available for printing. When a blank 50 as illustrated in FIG. 3 is foil coated on its front face, and folded into a package 10, the back face of back panel 40 will be the uncoated face of the blank 50, and will be available for printing identifying or display material. At the same time, the front faces of angle panel 42 and back panel 40 will be coated to provide an attractive appearance to the front of the package 10.

A specific preferred embodiment of the invention having been described, the following is claimed:

1. A package for retaining and displaying an article comprising an article retaining portion and a display portion for containing display material, said package including a single layer back panel having first and second sections, said article retaining portion comprising a bottom portion, an angle panel joined to one end of said bottom portion and extending at an acute angle therefrom and having an opening therethrough adapted to receive the article therethrough, said opening being dimensioned so as to prevent the article from being displaced through the opening, and a two layer back portion comprising said first section of said back panel and an upright panel joined to said bottom portion and having an upper end at which said angle panel is foldably connected to said upright panel, said upper end of said upright panel being disposed adjacent a location intermediate said first and second ends of said back panel, said display portion comprising said second section of said back panel.

2. A package as set forth in claim 1 wherein said bottom portion comprises a first bottom panel foldably connected to said first section of said back panel, a second bottom panel foldably connected to said first bottom panel and folded back to overlie said first bottom panel, and a third bottom panel foldably connected to said angle panel, and further comprising means for securing said third bottom panel to said first bottom panel.

3. A package as set forth in claim 1 further comprising means for securing said upright panel to said back panel.

4. A blank for forming a package for displaying and retaining an article comprising a single longitudinally extending sheet of material foldable to form the package, said sheet having a series of score lines extending transversely to the longitudinal extent of said sheet and dividing said sheet into a series of panels comprising a back panel, a first bottom panel, a second bottom panel, an upright panel, an angle panel, and a third bottom panel, said angle panel including means defining an opening therethrough for receiving the article therethrough, the opening being dimensioned so that the article may not be displayed through the opening when the blank is folded to form the package, the package comprising an article retaining portion including a bottom portion comprising said first, second and third bottom panels, and said upright panel, said angle panel and a first section of said back panel, and a display portion for containing display material comprising a second section of said back panel, said first bottom panel being folded at a generally right angle to said back panel, said second bottom panel being folded to overlie said first bottom panel, said upright panel being folded at a generally right angle to said second bottom panel to lie adjacent to and generally parallel to said back panel, said angle panel being folded at an acute angle to said upright panel, and said third bottom panel being folded at an angle to said angle panel to lie adjacent to and generally parallel to said first bottom panel.

5. A blank for forming a package for displaying and retaining an article, the package comprising an article retaining portion and a display portion extending above said article retaining portion, said blank comprising a single longitudinally extending sheet of material foldable to form the package, said sheet having a series of score lines extending transversely to the longitudinal extent of said sheet and dividing said sheet into a series of panels comprising a back panel, a first bottom panel, a second bottom panel, an upright panel, an angle panel, and a third bottom panel, said angle panel including means defining an opening therethrough for receiving the article therethrough, the opening being dimensioned so that the article may not be displaced through the opening when the blank is folded to form the package, the display portion of the package comprising a single layer of said sheet of material comprising a second section of said back panel.

6. A blank as set forth in claim 5 wherein the opening is dimensioned to allow a portion of the article to extend through the opening and be visible when the article is retained in the package.

7. A blank as set forth in claim 5 wherein the article retaining portion of the package includes a three-layer bottom portion comprising said first, second and third bottom panels, said upright panel, said angle panel, and a first section of said back panel, said upright panel and said first section of said back panel being folded to lie approximately against each other to form a two-layer back portion of the article retaining portion of the package, said upright panel having an upper end disposed adjacent a location intermediate the ends of said back panel.

* * * * *